US006293543B1

(12) United States Patent
Lawrence

(10) Patent No.: US 6,293,543 B1
(45) Date of Patent: Sep. 25, 2001

(54) UNIVERSAL SHEET RECEIVER FOR STACKERS

(75) Inventor: Frederick J. Lawrence, Tustin, CA (US)

(73) Assignee: Gradco (Japan) Ltd., Tokyo (JP)

( * ) Notice: Subject to any disclaimer, the term of this patent is extended or adjusted under 35 U.S.C. 154(b) by 0 days.

(21) Appl. No.: 09/237,790

(22) Filed: Jan. 26, 1999

(51) Int. Cl.[7] ..... B65H 31/04

(52) U.S. Cl. ..... 271/213; 414/788.9; 414/790.1; 271/207; 271/221; 271/238

(58) Field of Search ..... 271/207, 213, 271/220, 221, 286, 238, 218; 414/788.9, 790.1

(56) References Cited

U.S. PATENT DOCUMENTS 3,733,070 * 5/1973 Obenshain ..... 271/221
3,799,540 * 3/1974 Buccicone .
4,060,231 * 11/1977 Stobb et al. ..... 271/315
4,396,334 * 8/1983 Byrt ..... 414/791.2
4,469,321 * 9/1984 Geschwindner ..... 271/183
5,060,929 * 10/1991 Kohlmann ..... 271/218
5,188,353 * 2/1993 Parks ..... 271/184
5,370,382 * 12/1994 Wetter ..... 271/183
5,374,051 * 12/1994 Ulrich et al. ..... 271/222
5,431,530 * 7/1995 Kobayashi et al. ..... 414/794.4
5,649,695 * 7/1997 Lawrence ..... 270/58.12
5,681,036 * 10/1997 Wakahara et al. ..... 271/10.12
5,709,382 * 1/1998 Shima ..... 271/209
5,769,413 * 6/1998 Hummel et al. ..... 271/218
5,890,713 * 4/1999 Hofmann et al. ..... 271/221
5,895,042 * 4/1999 Allmendinger et al. ..... 271/245
6,090,030 * 7/2000 Rogers ..... 493/363

* cited by examiner

*Primary Examiner*—Robert P. Olszewski
*Assistant Examiner*—Richard Ridley
(74) *Attorney, Agent, or Firm*—Newton H. Lee, Jr.

(57) ABSTRACT

Sheet receiving apparatus is disclosed for receiving paper sheets from a supply of printed sheets, aligning the sheets edgewise, dropping the sheets to a receiver tray through horizontally openable preliminary sheet supporting plates, the sets of sheets being either stacked in vertical alignment or horizontally offset relationship, and in one form means are provided for stapling the sets of sheets.

10 Claims, 8 Drawing Sheets

UNIVERSAL SHEET RECEIVER FOR STACKERS

BACKGROUND OF THE INVENTION

In the prior art there are extant various modes and systems for facilitating the stacking of sheets on or in a receiving tray, including the following prior art.

Lawrence U.S. Pat. No. 5,649695, granted Jul. 7, 1997 discloses a continuous finishing apparatus for copiers and printers in which sheets exiting the host machine are supported at their trailing edge on a retractable shelf and on their leading ends on a mechanism which is laterally shiftable. The shelf is retracted and the laterally shiftable mechanism is opened to allow the sheets to fall upon a stacker, after a set of the sheets has been finished.

In the pending application of Coombs, Ser. No. 09/078,202, filed May 14, 1998, commonly owned herewith, sheet finishing apparatus is shown having vertically spaced pairs of trays which are laterally pivotable to allow the sheet to progressively move downwardly to a stacker during the finishing of sheets by stapling or binding.

In essence, the state of the prior art appears to be that it is well known to support sheets and accumulate sets of sheets for binding or stapling on devices which finish the sets of sheets and then move the sheets to a stacker or receiver, as more particularly shown in Hiroi, et al U.S. Pat. No. 5,385,340, granted Jan. 31, 1995, wherein the sheets are arranged in a stack supported partially on a stacker and partially on a ledge from which the finished sets of sheets are pushed so as to rest entirely on the stacker.

SUMMARY OF THE INVENTION

The present invention involves providing a sheet receiving apparatus which is applicable to various stackers of the type having a stacker tray progressively vertically downwardly movable as the sets are deposited on the stacker tray, as is customary in the art of stacking.

The receiving apparatus of the present invention is adapted to receive sheets progressively fed from the outlet from a copier or printer upon a pair of horizontally shiftable support plates on which the sheets may be jogged into side edge alignment, and, in one form of the invention, stapled, but in any event, being dropped onto the usual stacker tray, either in a uniform vertically disposed stack or in a stack in which the respective jobs have been offset.

In particular, an object of the invention is to provide a universal sheet receiving apparatus which may be applied to a variety of stacking bases and which functions to receive, align and deposit the sheets upon the sheet stacker, either stapled or not stapled.

Other objects of the invention will be apparent from the following description and the accompanying drawings.

DESCRIPTION OF THE PREFERRED EMBODIMENT

Figure 1:
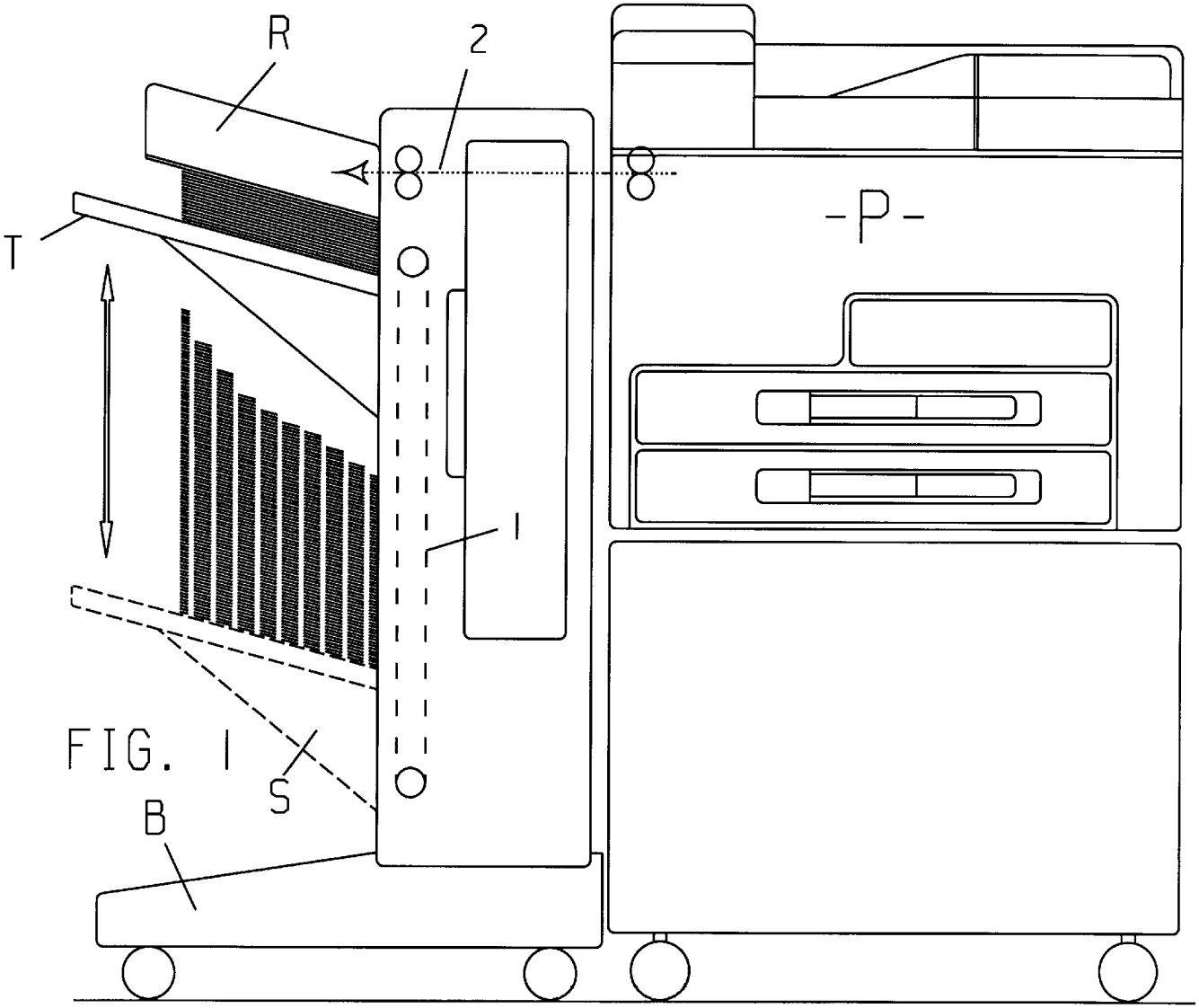
FIG. 1 is a side elevation of stacking apparatus adapted for use in conjunction with a copying or printing machine and incorporating the sheet receiver of the invention.

As seen in FIG. 1, a stacker S is mounted on a roll up base B of a standard stacker on which a stacker tray T is mounted for upward and downward movement on belts 1 under the control of a suitable control system which, as is well known, is adapted to progressively lower the tray T as sheets or sets of sheets are stacked thereon during operation of the printer or copier P, as the sets are fed in the direction of the arrow through an infeed 2 into the sheet receiving apparatus R of the present invention.

Figure 2:
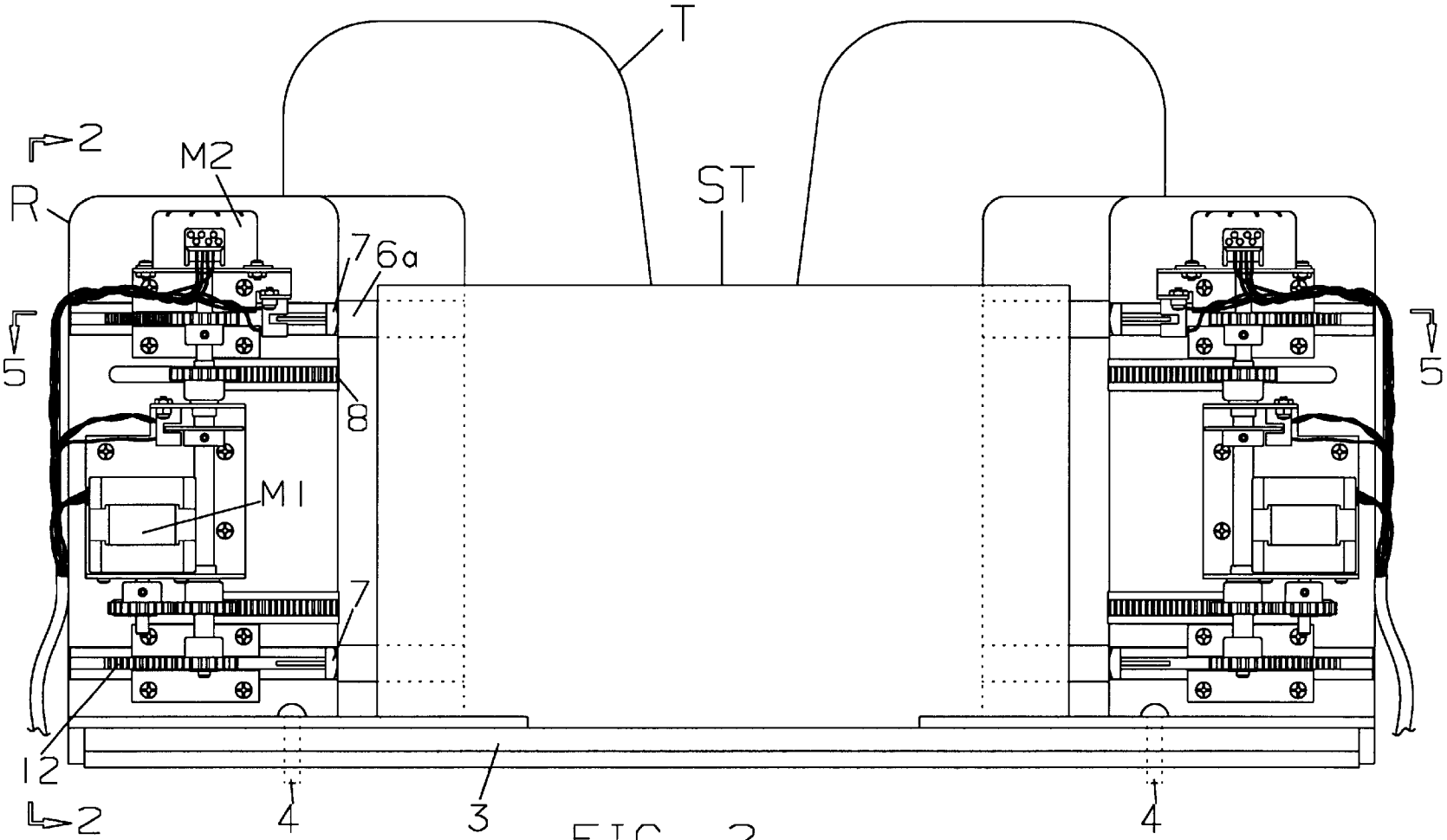
FIG. 2 is a top plan view thereof with covers removed.
Figure 2A:
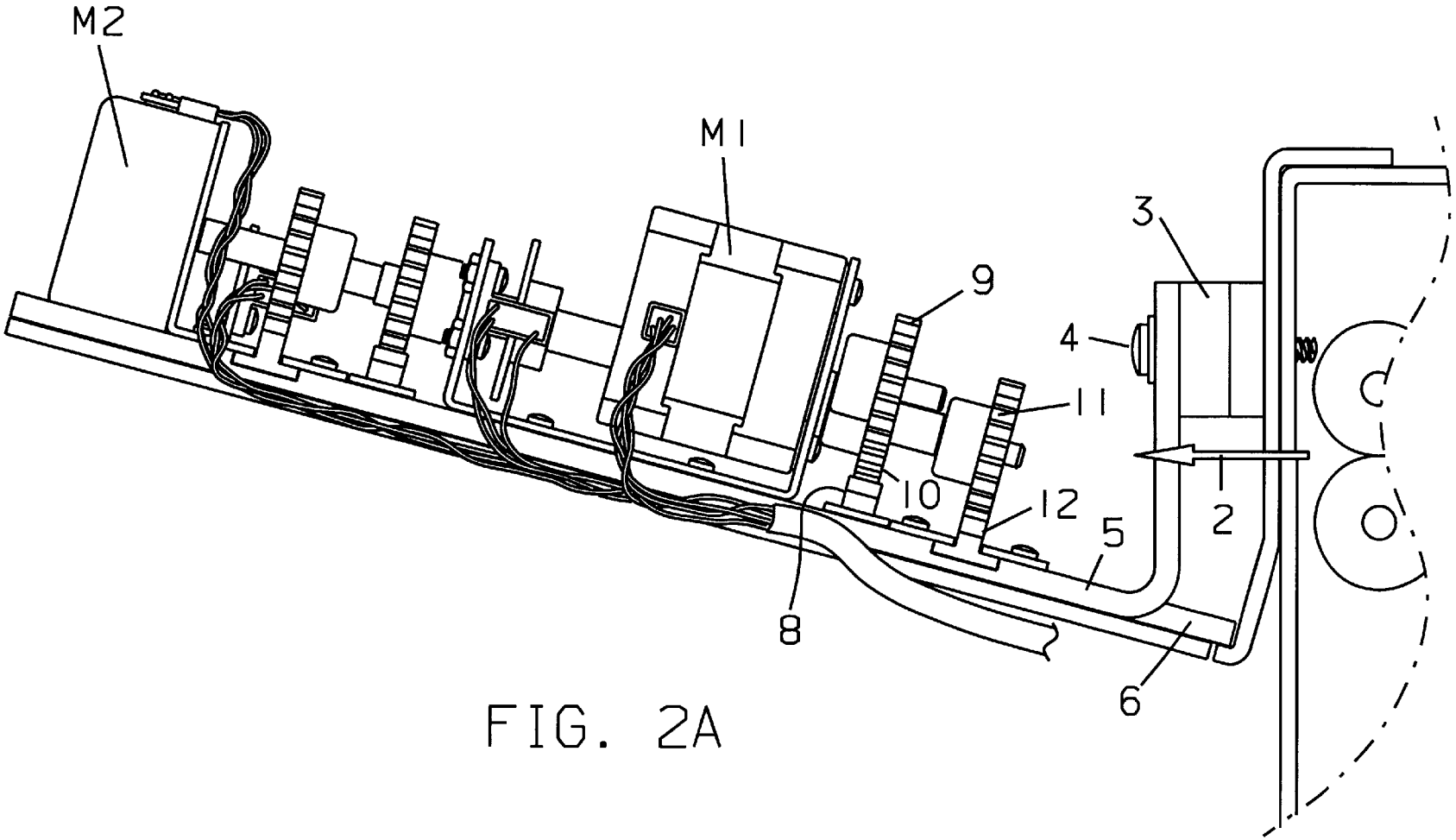
FIG. 2A is a section embraced by line 2—2 of FIG. 2.
Figure 3:
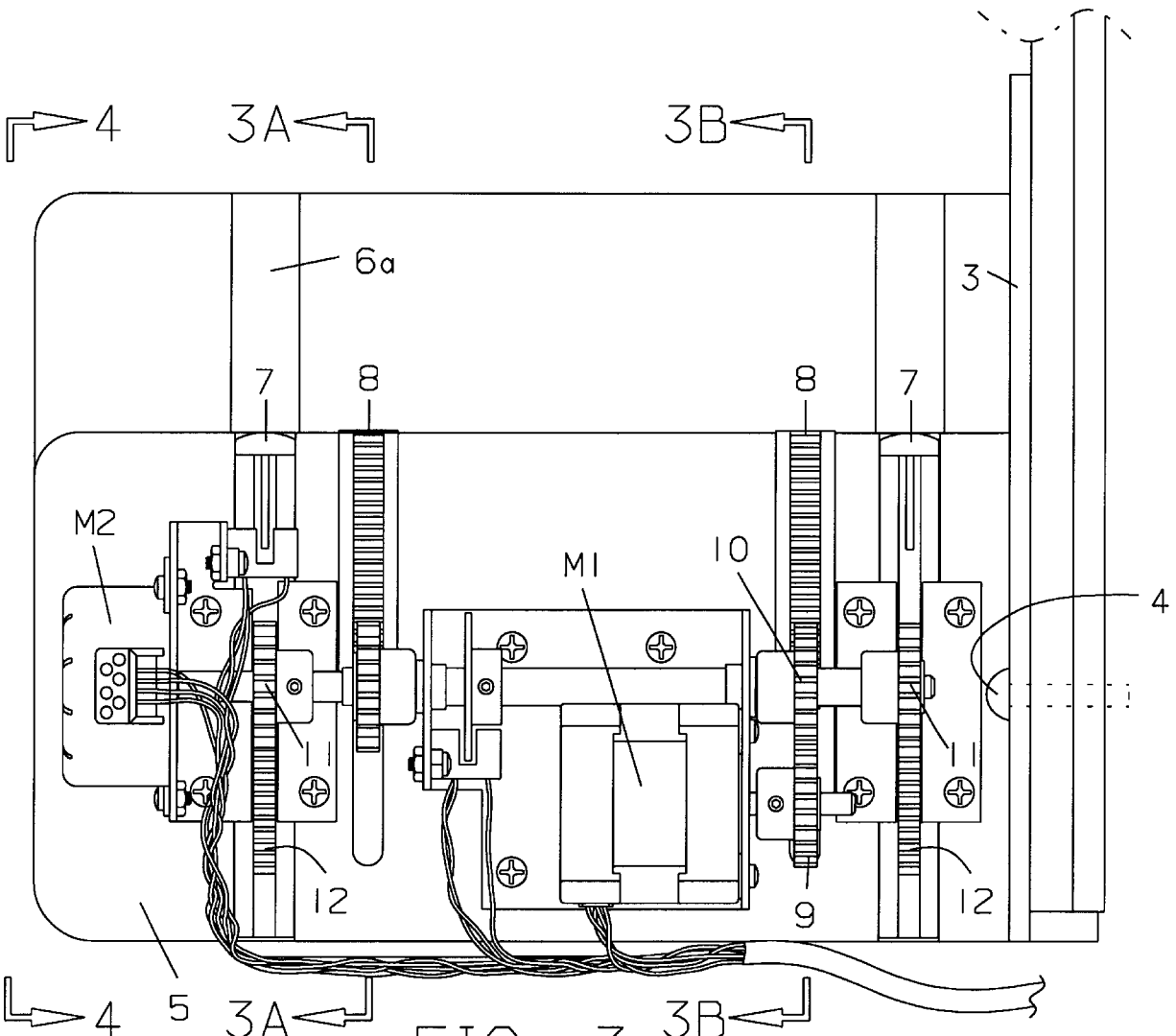
FIG. 3 is an enlarged top plan of one side of the apparatus with the sheet supporting plate fully extended.

Referring to FIGS. 2 and 3, it will be seen that there are two reversely constructed side paper supports which are selectively connectable to the stacker S by suitable support means 3 and fasteners 4. Each of the sheet supporting means or structures includes a frame bearing base 5 below which is mounted a support plate 6 adapted to be extended and retracted from beneath the plate 5 by a motor M1. A motor M2, which is a stepper motor, is adapted to drive inwardly and outwardly joggers 7.

The motor M1 is reversible and adapted through a pair of racks, or other comparable means, to extend the sheet support plate 6 by gearing 9 and 10, gear 10 being engaged with the racks 8 so as to cause extension and retraction of the plate 6. Motor M2 is adapted to drive gears 11 which are engaged with racks 12, or other comparable means, so as to extend and retract the jogger 7.

In the preferred form illustrated, the motor driven gear 9 engages the respective gears 10 which are mounted on an external shaft 13 (best seen in FIGS. 3B and 3C) through which an internal shaft 14 extends for extending and retracting the jogger 7 by reverse rotation of motors M1 and M2.

Figure 3A:
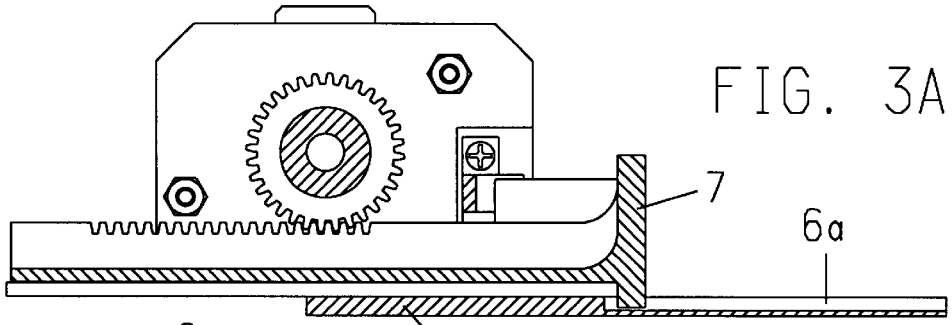
FIG. 3A is a vertical section on the line 3A—3A of FIG. 3.
Figure 3B:
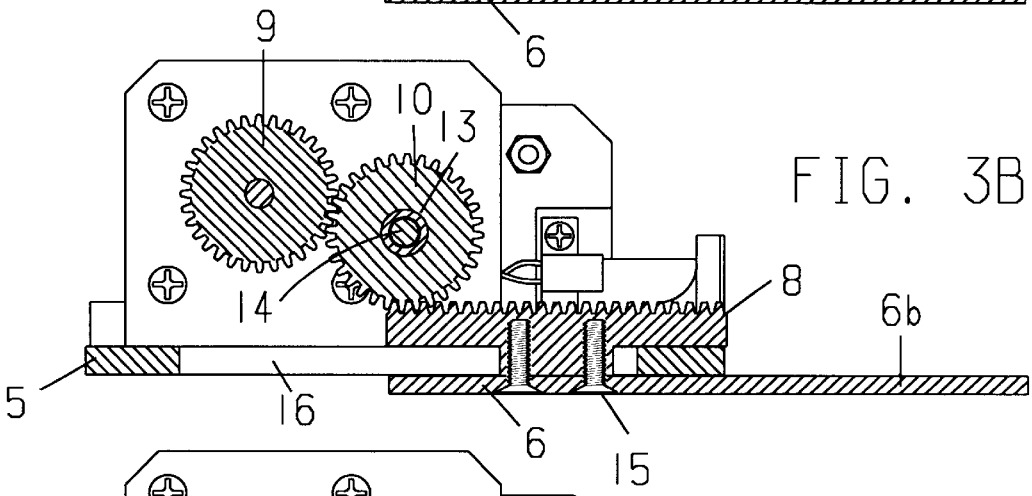
FIG. 3B is a vertical section on the line 3B—3B of FIG. 3.
Figure 3C:
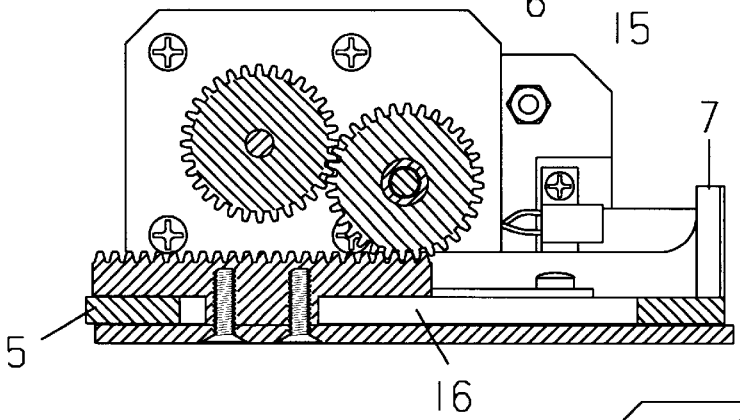
FIG. 3C is a view corresponding with FIG. 3 but showing the sheet supporting tray retracted.
Figure 4:
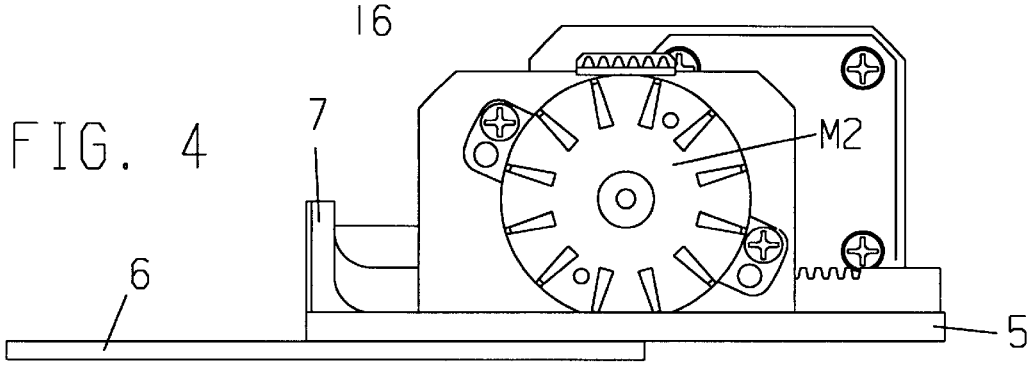
FIG. 4 is a side elevation of the portion of the receiver embraced by the line 4—4 of FIG. 3.

Referring to FIG. 3A, the jogger 7 is shown in a retracted position while the plate 6 is shown in an extended position. The plate 6 is grooved at 6*a* to allow the jogger 7 to extend below the sheet supporting top surface of the plate which, as seen in FIG. 3B, is designated 6*b*. Suitable fastenings 15 connect the sheet support plate 6 to a portion of the rack 8 extending downward through a slot 16 in the base plate 5.

A similar structure is at the opposite side of the apparatus from the side shown in FIG. 3.

The mode of operation of the structure, for purposes of receiving and offsetting stacks of sheets ST, is seen by reference to FIGS. 5A through 5E, in which it will be seen that the support plate 6, at each side of the apparatus, is extended one toward the other so that a stack of sheets is supported thereby, as the sheets exit the copier or printer P.

The stacker tray T is independent of the sheet receiving apparatus R and is adapted to progressively move downwardly as sets are stacked thereon.

Figures 5A, 5B, 5C, 5D, 5E:
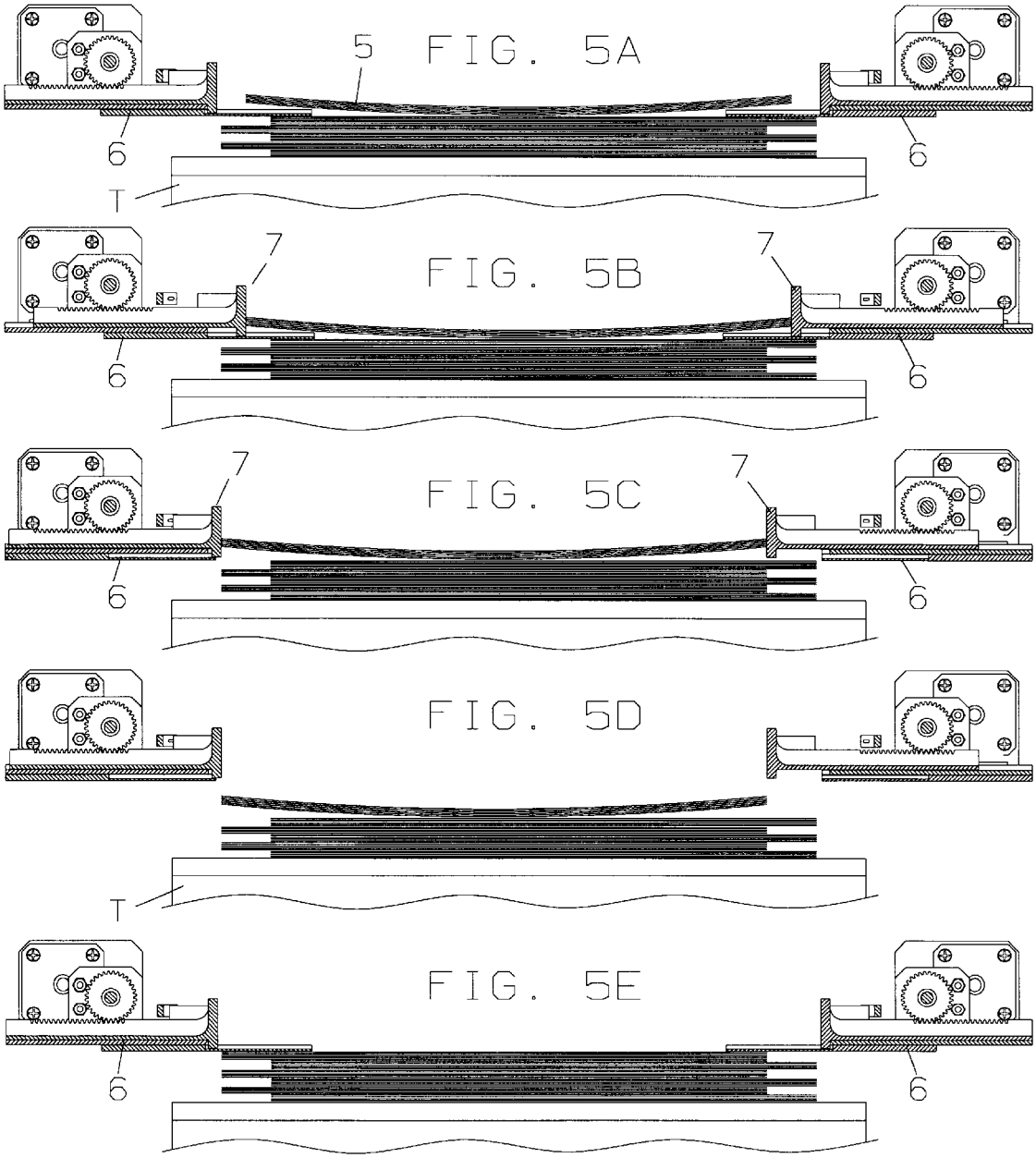
FIGS. 5A through 5E are vertically spaced diagrammatic illustrations of the sheet receiving apparatus to receive and stack sheets in an offset relationship.
Figure 5F:
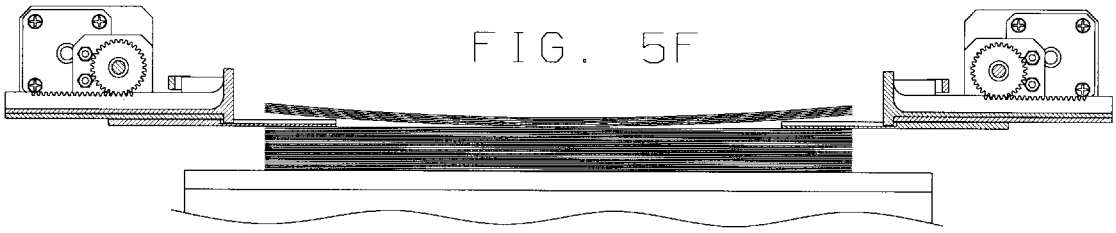
FIGS. 5F through 5J are views corresponding to FIGS. 5A—5E, but showing the sheet receiving apparatus functioning to stack sets of sheets in a non-offset relationship.
Figure 5G:
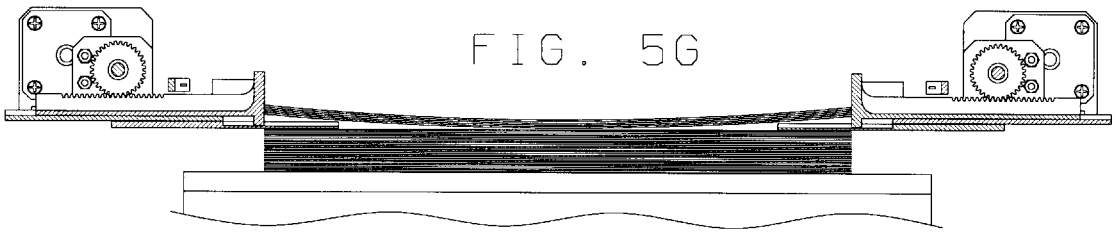
Figure 5H:
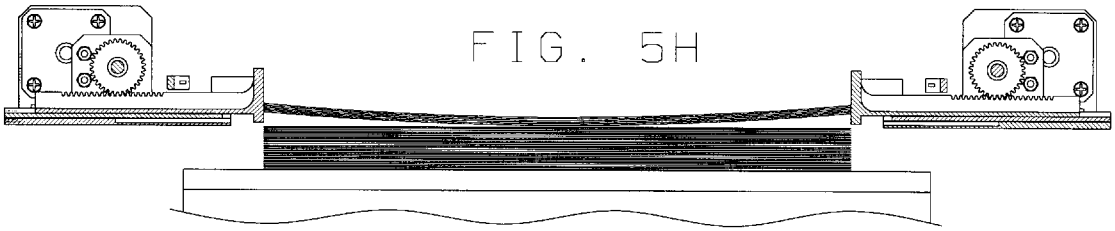
Figure 5I:
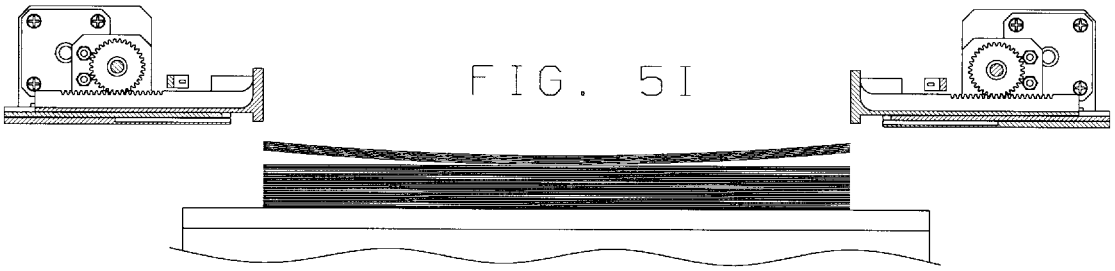
Figure 5J:
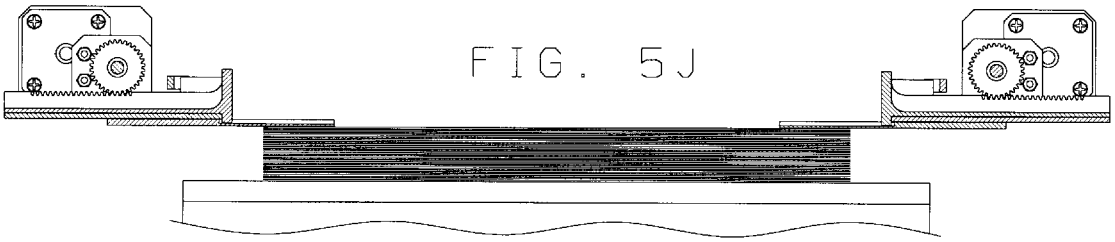

As seen in FIG. 5B, the joggers 7 have been moved toward one another so as to contact and edge align the sheets in the stack which is supported on the extensible and retractable plates 6.

In FIG. 5C, however, the plates 6 are retracted so that the set of sheets is free to gravitate to the top of the previously stacked set in an offset relation, as the stacker tray T has been moved downwardly by the usual stacker tray control means.

In FIG. 5D the set of sheets has been allowed by downward movement of tray T to fall in jogged and offset relation to the previously standard set.

In FIG. 5E, it will be seen that the sheet supporting plates 6 have again been returned toward one another in preparation for receiving an additional set of sheets.

In FIGS. 5F through 5J, the operation of the receiver is shown as functioning simply to receive progressive sets of sheets, jog the sheets into edge alignment and drop the sets, which are stacked one on the other in vertical alignment.

Figure 6:
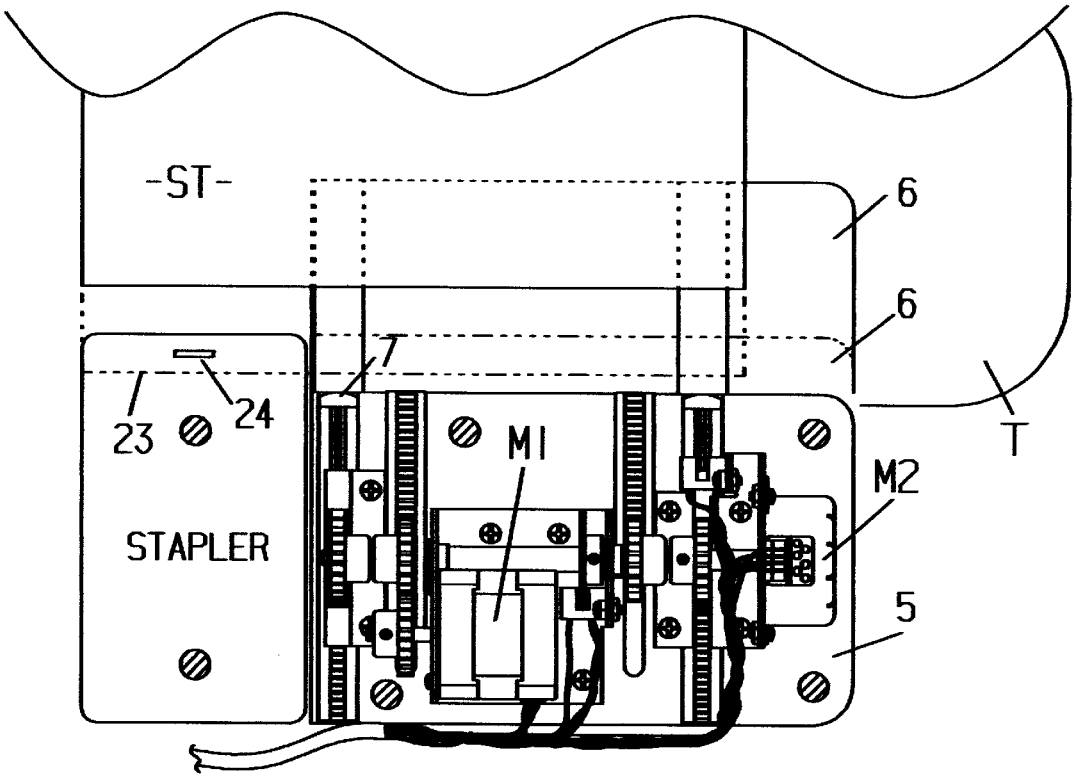
FIG. 6 is a top plan illustrating a modification of the apparatus provided with a means for stapling the sets in one corner thereof, with the covers removed.
Figure 7:
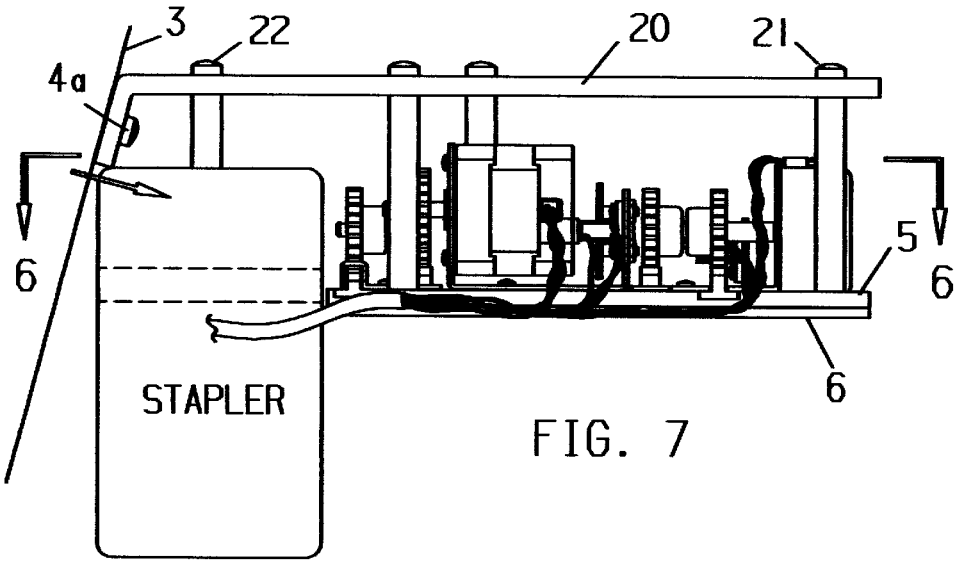
FIG. 7 is a section on the line 6—6 of FIG. 7.

Referring to FIGS. 6 and 7, the apparatus is shown as including means for stapling or finishing the sets before they are dropped from the plate 6 onto the stacker tray T.

In this embodiment, the supporting structure for the frame plate 5 is shaped so as to accommodate the "STAPLER" and an upper mounting bracket 20 hangs the plate 5 by suitable fastenings 21 and a fastener 4*a* attaches the bracket 20 to the support structure 3.

In addition the bracket 20 provides support for the STAPLER as by means of fastenings 22.

The set of sheets ST, as previously indicated, is movable by the stepper motor M2 and the jogging members 7, so that, as shown in FIG. 6, the set ST can be moved into a slot 23 in the stapler for permitting the driving of a staple shown at 24 through the set of sheets when the set is in the broken line position of FIG. 6. Thereafter, the jogging members 7 may be returned to cause movement of the set ST from the stapler slot or throat back to a position at which the plates 6 may be opened to deposit the sets on the stacker tray T in either the offset or non-offset relation, but preferably with the stacked set offset to minimize the effect of the staple thickness on the ability of the stacker tray to hold a maximum of stacked sets.

In the embodiment, as illustrated in FIGS. 6 and 7, it will be seen that the mechanism for extending and retracting the plate 6 and extending and retracting the joggers 7 is the same as described previously. It is also possible within the purview of the invention to modify the jogging structure to provide a single jogging member 7 extendable and retractable relative to the apparatus at the opposite sides of the inlet to the receiver.

Other changes and alterations may be made in the structure or the arrangement of parts of the apparatus.

What is claimed is:

1. Paper sheet receiving apparatus applicable to a printed paper sheet stacking machine having a paper sheet receiving tray vertically movable downwardly to receive printed paper sheets thereon comprising: means for locating the apparatus adjacent to the sheet outlet of a printed paper sheet reproducing machine to receive said sheets therefrom, means for receiving said sheets including a pair of plates reciprocable horizontally towards and away from one another, means for jogging said sheets relative to said pair of plates and reciprocable relative to said plates, and means including motors for independently reciprocating said sheet jogging means and said pair of plates whereby sheets are jogged while supported on said plate and dropped onto said sheet receiving tray when said plates are reciprocated away from one another.

2. Paper sheet receiving apparatus as defined in claim 1, wherein said jogging means includes members slidable above said plates.

3. Paper sheet receiving apparatus as defined in claim 1, wherein said jogging members slide above said plates in grooves in the upper surfaces of said plates.

4. Paper sheet receiving apparatus as defined in claim 1, wherein said motors include a first motor for reciprocating said sheet jogging means, a second motor for reciprocating said plates independently.

5. Paper sheet receiving apparatus as defined in claim 4, wherein said first motor is a stepper motor.

6. Paper sheet receiving apparatus as defined in claim 4, including gearing for moving said jogging means and said plates independently responsive to said first and second motors.

7. Paper sheet receiving apparatus as defined in claim 6, said gearing including shafts extending coaxially one about the other.

8. Paper sheet receiving apparatus as defined in claim 1, including means for binding sets of said sheets supported on said pair of plates prior to reciprocation of said plates away from one another.

9. Sheet receiving apparatus as defined in claim 1, including binding means for binding sets of sheets supported on said pair of plates prior to reciprocation of said plates away from one another while said jogging members engage said sheets in edge alignment.

10. Paper sheet receiving apparatus as defined in claim 1, including means for finishing sets of sheets supported on said pair of plates prior to reciprocation of said plates away from one another while said jogging means engage said sheets in edge alignment and move said sheets into and from said means for finishing.

* * * * *